US007007388B2

(12) United States Patent
Wan

(10) Patent No.: US 7,007,388 B2
(45) Date of Patent: Mar. 7, 2006

(54) HAIR TRIMMING DEVICE

(75) Inventor: Yiu Chung Wan, New Territories (CN)

(73) Assignee: King Tai Holdings Limited, Kwai Chung (HK)

( * ) Notice: Subject to any disclaimer, the term of this patent is extended or adjusted under 35 U.S.C. 154(b) by 0 days.

(21) Appl. No.: 10/716,531

(22) Filed: Nov. 20, 2003

(65) Prior Publication Data

US 2005/0108880 A1 May 26, 2005

(51) Int. Cl.
*B26B 19/00* (2006.01)

(52) U.S. Cl. ..... 30/30; 30/123

(58) Field of Classification Search ..... 30/264, 30/240, 43.6, 123, 124, 30

See application file for complete search history.

(56) References Cited

U.S. PATENT DOCUMENTS 2,524,822 A * 10/1950 Neidig ..... 30/43.6
5,832,939 A * 11/1998 Nathe ..... 132/225
5,884,402 A 3/1999 Talavera
6,588,108 B1 * 7/2003 Talavera ..... 30/133

* cited by examiner

*Primary Examiner*—Allan N. Shoap
*Assistant Examiner*—Omar Flores Sánchez
(74) *Attorney, Agent, or Firm*—Buchanan Ingersoll PC

(57) ABSTRACT

A hair trimming device is disclosed as including a first body part and a second body part, the first body part having a first end pivotally secured with a first end of the second body part for relative pivotal movement, the first body part including a brush portion at a second end distal from its first end, the brush portion including a recess, the second body part having a lever and a ruler pivotally engaged with each other, in which the ruler is receivable within the recess of the brush portion for holding hair between the brush portion and the ruler for trimming.

10 Claims, 5 Drawing Sheets

HAIR TRIMMING DEVICE

This invention relates to a hair trimming device, and in particular such a trimming device for removing a length of hair from the end of hair so trimmed.

BACKGROUND OF THE INVENTION

A prior art hair trimming device is disclosed in U.S. Pat. No. 5,884,402 issued to Talavera. Talavera discloses a hair trimming device for cutting substantially equal portions of hair from the distal end of hair shafts. The trimming device has a brush-like body having a handle end and a head end. The head end has a co-operating slot for receiving a selectively biased roller about the interior of the slot. Strands of hair are placed between the slot in the head end of the body and the roller. A roller actuating lever at the handle end of the body may be depressed by a user. Depressing of the lever depresses the roller into the slot by rotating a cooperating mechanism connected to both the roller and lever causing the roller to depress. The user inserts hair strands between the raised roller and slotted side of the head end and thereafter the roller sinks into the slot at a predetermined bias to put tension on the hair strands. The device is then pulled through the hair in a brush like fashion causing only the distal ends of hair moving between the roller and slot to rise into a cutting blade in which substantially equal portions of the end of the individual hairs are removed while leaving adjacent longer hair strands uncut until their ends are drawn through the device.

A shortcoming associated with a hair trimming device according to Talavera is that the cooperating hinge apparatus for raising and lowering the roller from the handle slot is rather complicated and thus costly to manufacture. In addition, during operation of a hair trimming device according to Talavera, in particular when the lever is pressed towards the handle end portion to lower the roller into the handle slot, the user's hand may be accidentally caught between the lever and the handle end portion, thus possibly hurting the user.

It is thus an object of the present invention to provide a hair trimming device in which the aforesaid shortcomings are mitigated, or at least to provide a useful alternative to the public.

SUMMARY OF THE INVENTION

According to the present invention, there is provided a hair trimming device including a first body member and a second body member, said first body member having a first end pivotally secured with a first end of said second body member for relative pivotal movement, said first body member including a brush portion at a second end distal from its said first end, said brush portion including a recess portion, said second body member having first and second lever members pivotally engaged with each other, wherein at least part of said second lever member is receivable within said recess portion of said brush portion for holding hair between said brush portion and said second lever member for trimming.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
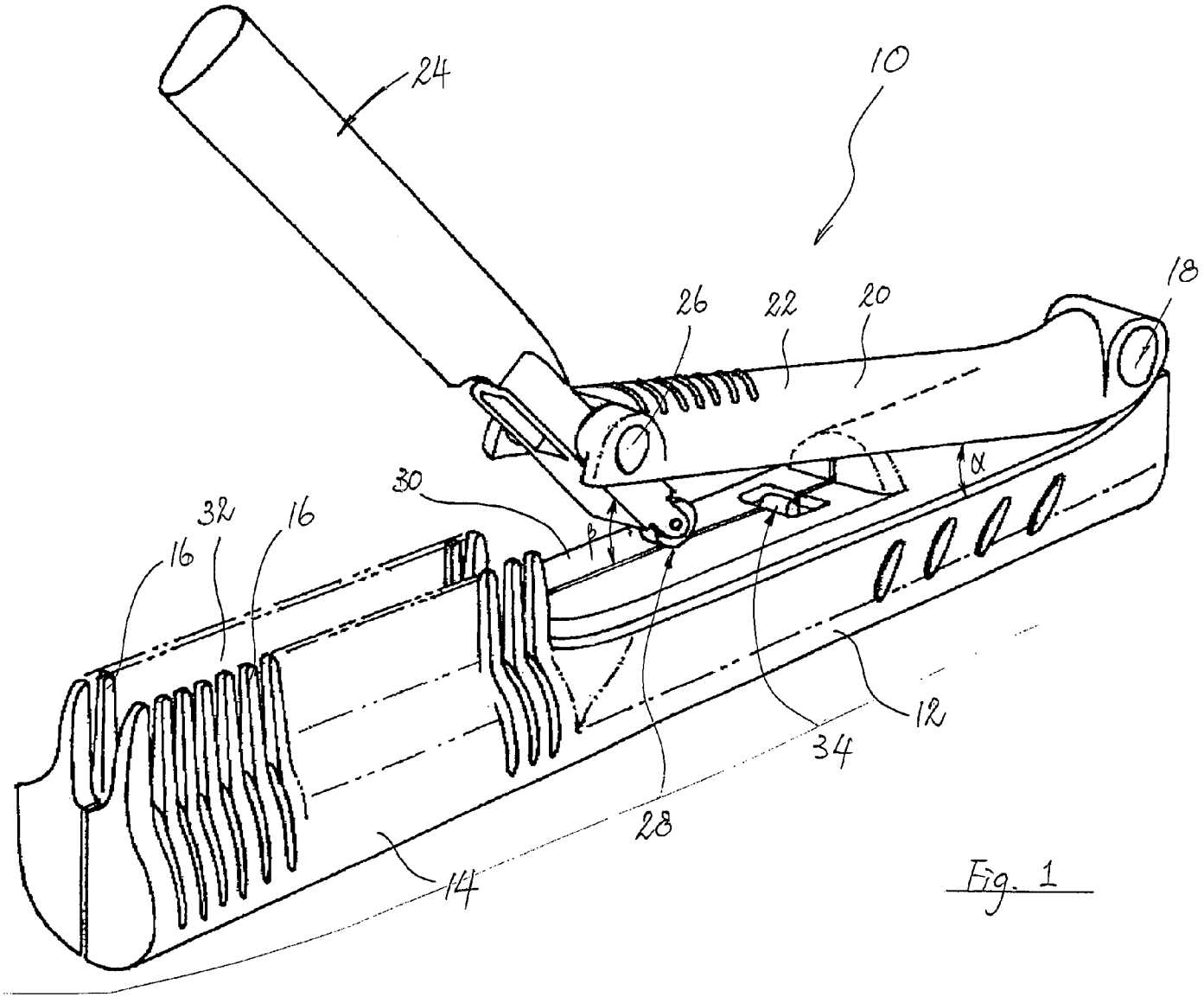
FIG. 1 is a perspective view of a hair trimmer according to the present invention.

A perspective view of a hair trimming device, in particular an electric hair trimming device, is shown in FIG. 1, and generally designated as 10. The device 10 includes a first body part 12 with a brush portion 14 at one longitudinal end thereof. A number of bristles 16 are provided at the brush portion 14. A second longitudinal end of the first body part 12 is pivotally connected with a second body part 20 of the device 10, allowing the first body part 12 and the second body part 20 to pivot relative to each other. A spring coil (not shown) is provided at the pivot point 18 between the first body part 12 and the second body part 20, which biases the second body part 20 away from the first body part 12 towards an open position, as shown in FIG. 1.

The second body part 20 includes lever members 22, 24 which are pivotally connected at 26. The lever member 24 is in the form of a ruler whose function will be discussed further below. A spring coil (not shown) is provided in the pivot point 26 to bias the ruler 24 towards the stable open position as shown in FIG. 1. It can be seen that, when at this open position, the angle $\alpha$ between the lever member 22 and the first body part 12 is smaller than the angle $\beta$ between the ruler 24 and the first body part 12.

A longitudinal end of the ruler 24 carries a sliding wheel 28 which moves along an inner surface 30 of the first body part 12 during movement of the ruler 24 relative to the first body part 12. In particular, when the ruler 24 is moved into a recess 32 of the brush portion 14, the sliding wheel 28 acts on a micro switch 34 in the first body part 12 to activate the device 10. Once the ruler 24 is moved away from the recess 32, the sliding wheel 28 will also move away from the micro switch 34, thus deactivating the device 10.

Figure 2:
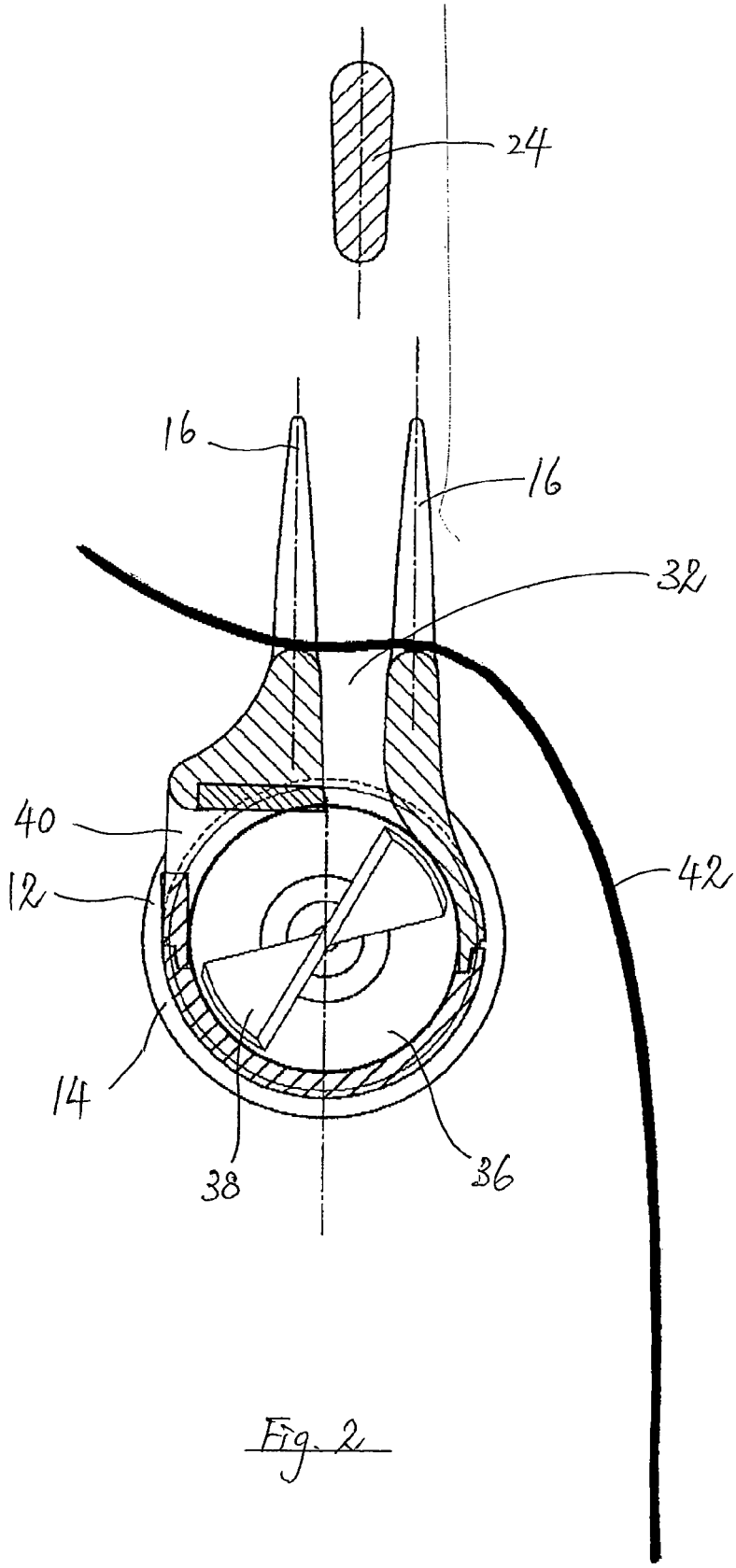
FIG. 2 is a transverse sectional view of the hair trimmer shown in FIG. 1 in an open configuration, in which a strand of hair is placed in the brush portion.

Referring now to FIG. 2, such is a transverse sectional view of the device 10, in which the ruler 24 is away from the recess 32 of the first body part 12. As can be seen in FIG. 2, contained in a generally cylindrical cavity 36 of the brush portion 14 is a rotary cutter 38 which is driven to rotate along an axis parallel to the longitudinal axis of the first body part 12. The cavity 36 communicates with the recess 32 into which the ruler 24 may be received. An outlet 40 is provided on a side of the brush portion 14 allowing cut hair to be emptied from the cavity 36. A strand of hair 42 may be received among the bristles 16 of the brush portion 14, as in usual brushing action.

Figure 3:
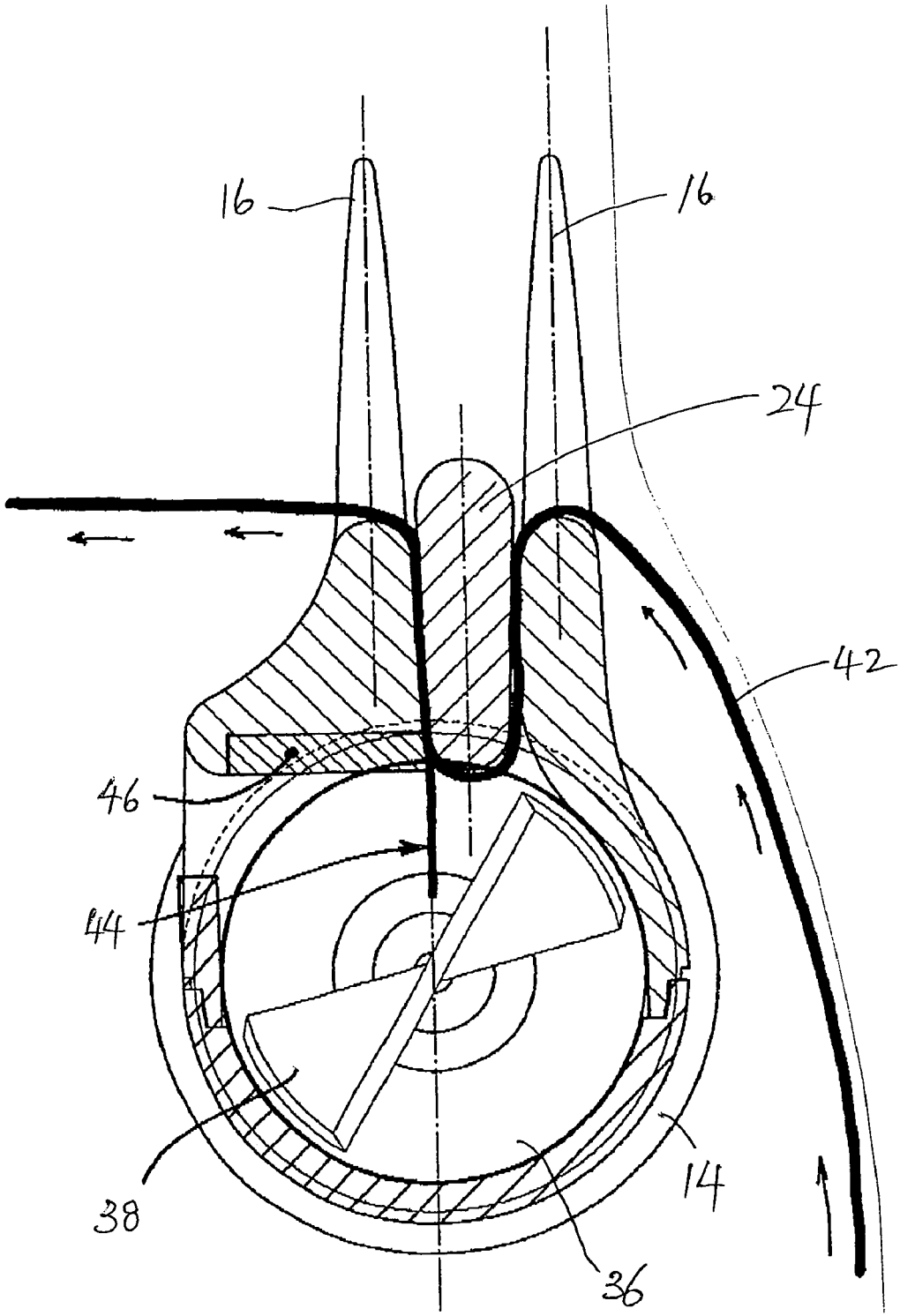
FIG. 3 is a transverse sectional view of the hair trimmer shown in FIG. 2 in a closed configuration, in which the strand of hair is held between the brush portion and the ruler.

Turning now to FIG. 3, when the ruler 24 is moved into the recess 32, while the strand of hair 42 is held between the ruler 24 and the brush portion 14, the device 10 may be moved relative to the hair 42. When the ruler 24 is at this position, and as discussed above, the sliding wheel 28 carried by the ruler 24 will engage the micro switch 34 and activate the device 10. When the device 10 is thus activated, the rotary cutter 38 will rotate in an counter-clockwise direction.

When the device 10 is moved relative to the strand of hair 42, an end 44 of hair will extend into the cavity 36. The rotary cutter 38 will then cut away the end 44, against a stationary blade 46.

Figure 4A:
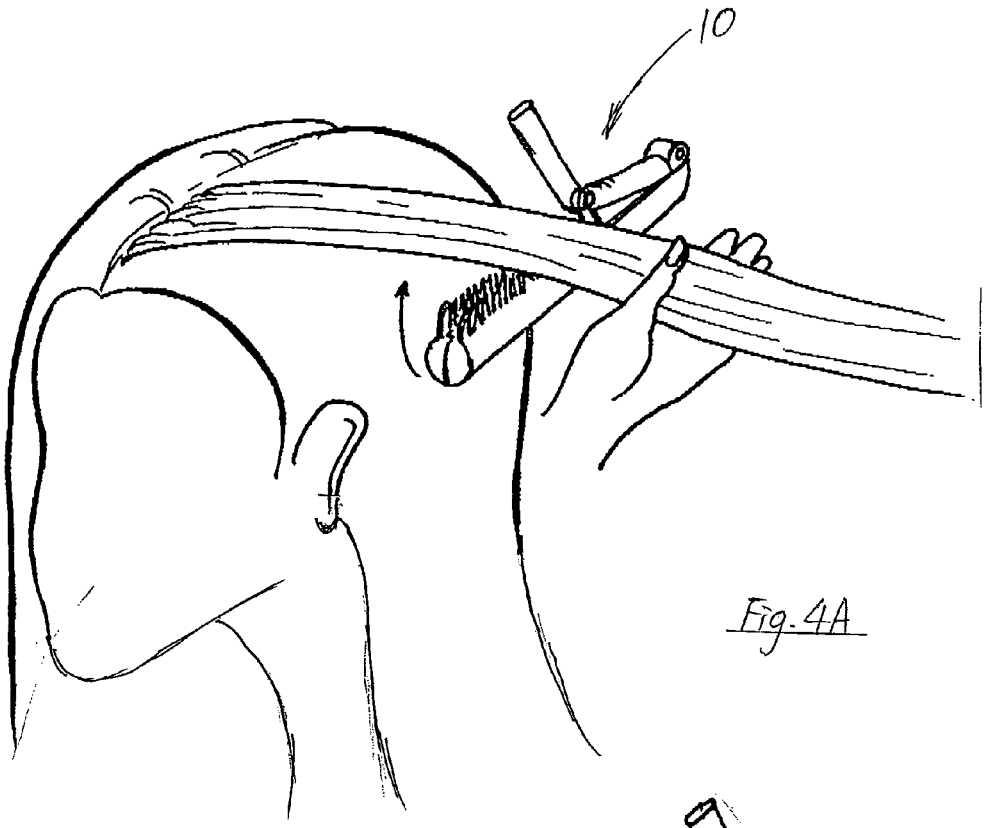
FIG. 4A to 4C show the manner of operation of the hair trimmer shown in FIG. 1.
Figure 4B:
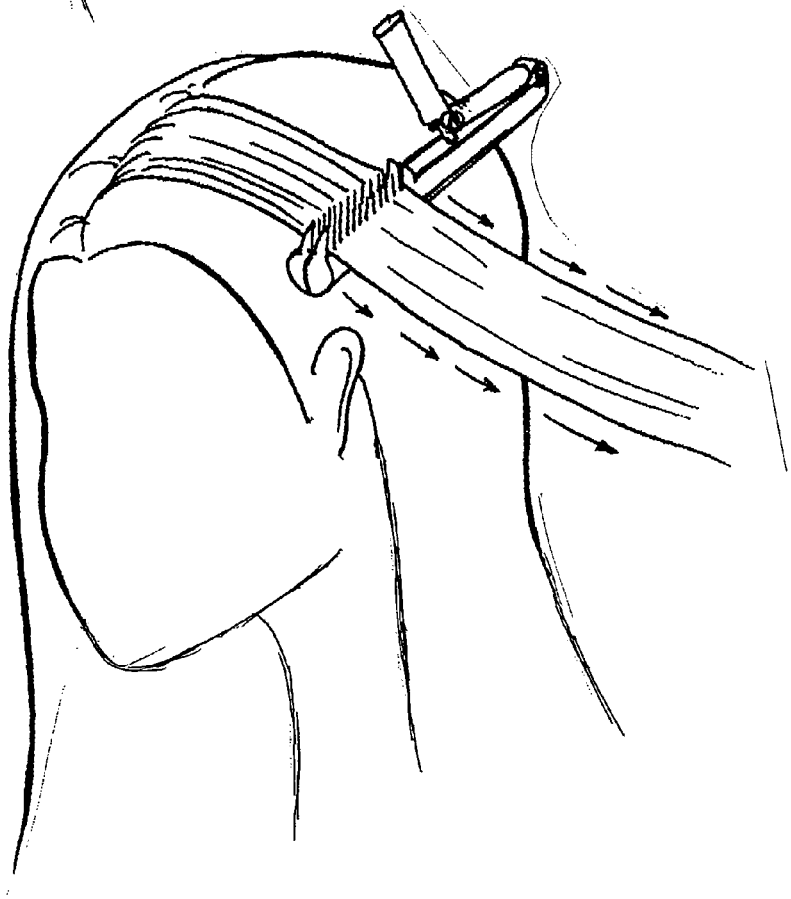
Figure 4C:
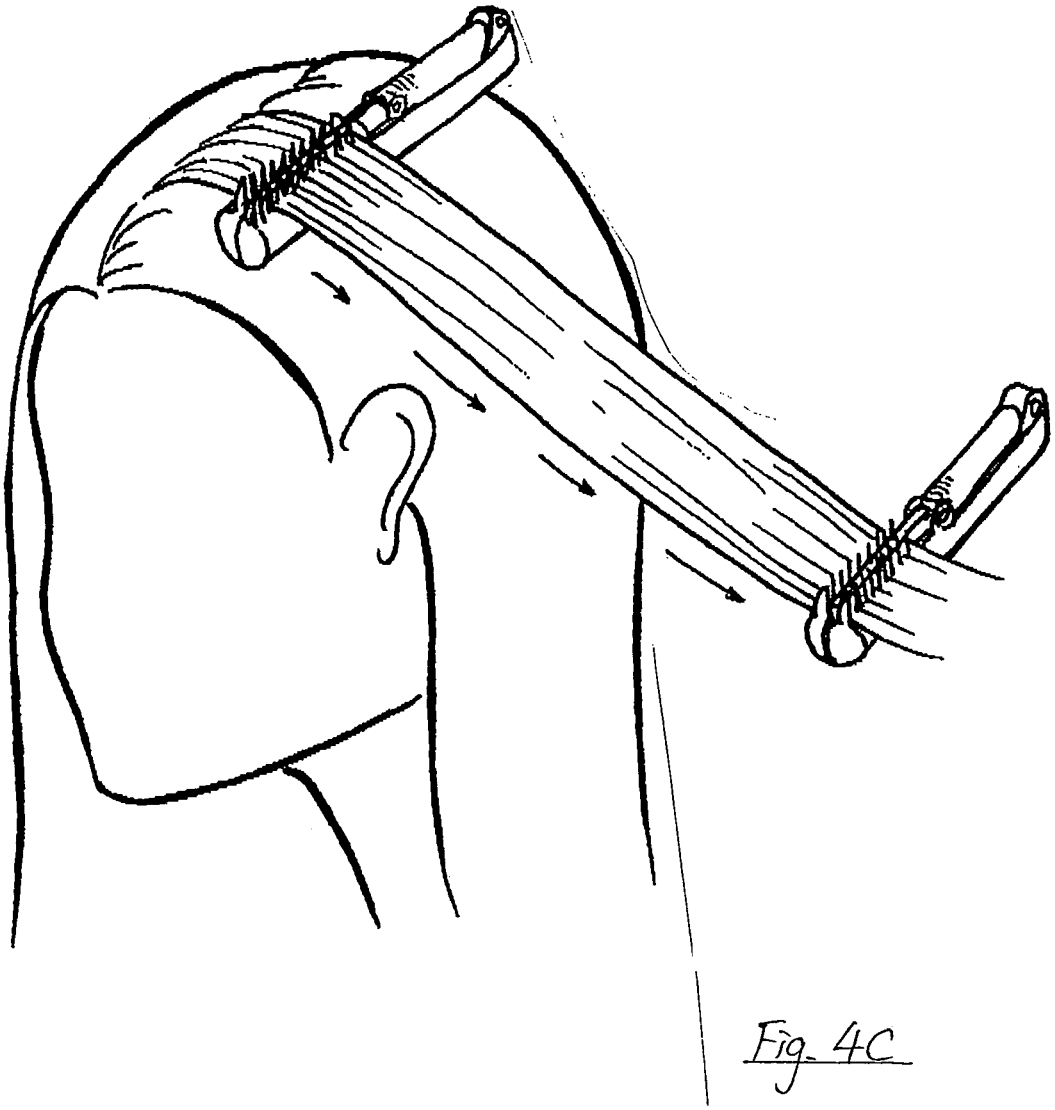

FIGS. 4A to 4C show the manner of operation of the hair trimmer 10. As shown in FIG. 4A, the device 10 is placed under the strands of hair to be cut, with the ruler 24 and the lever 22 at the open position. The strands of hair are then combed by the brush portion 14 from below in a combing movement to organize the hair before trimming. The device 10 is subsequently moved back close to the root portion of the hair, as shown in FIG. 4B. A user then presses on the lever 22, e.g. by using his/her thumb, thus causing the ruler 24 to move into the recess 32. When the ruler 24 is thus received within the recess 32, the hair is held between the ruler 24 and the brush portion 14. The sliding wheel 28 thus acts on the micro switch 34 to activate the device 10, and thus the rotary cutter 38. The device 10 is then moved slowly towards the end of the hair, during which the rotary cutter 38 rotates and cuts ends of hair extending into the cavity 36.

When the pressure acting on the lever 22 is released, the spring coil between the lever 22 and the first body part 12 will move the lever 22 and the first body part 12 apart so that the lever 22 will assume the open position as shown in FIG. 1. In addition, the spring coil between the lever 22 and the ruler 24 will bias the ruler 24 further away from the first body part 12 to assume the open position as shown in FIG. 1.

It should be understood that the above only illustrates an example whereby the present invention may be carried out, and that various modifications and/or alterations may be made thereto without departing from the spirit of the invention.

It should also be understood that various features of the invention which are here, for brevity, described in the context of a single embodiment, may be provided separately or in any appropriate sub-combinations.

What is claimed is:

1. A hair trimming device including a first body member and a second body member, said first body member having a first end pivotally secured with a first end of said second body member for relative pivotal movement, said first body member including a brush portion at a second end distal from its said first end, said brush portion including a recess portion, said second body member having first and second lever members pivotally engaged with each other, wherein said first lever member has a first end pivotally secured to said first end of said first body member, and a second distal end pivotally engaged with said second lever, and wherein at least part of said second lever member is receivable within said recess portion of said brush portion for holding hair between said brush portion and said second lever member for trimming.

2. A device according to claim 1 wherein said brush portion includes a cutting mechanism, said cutting mechanism having a cavity communicating with said recess portion and including a cutting member movable to cut hair extending into said cavity.

3. A device according to claim 1 wherein said second body member is movable relative to said first body member between a stable open position in which said second lever member is away from said recess portion of said brush portion, and a closed position in which at least part of said second lever member is received within said recess portion.

4. A hair trimming device including a first body member and a second body member, said first body member having a first end pivotally secured with a first end of said second body member for relative pivotal movement, said first body member including a brush portion at a second end distal from said first end, said brush portion including a recess portion, said second body member having first and second lever members pivotally engaged with each other, wherein said second body member is movable relative to said first body member between a stable open position in which said second lever member is away from said recess portion of said brush portion, and a closed position in which at least part of said second lever member is received within said recess portion for holding hair between said brush portion and said second lever member for trimming, and further including a wheel member carried by said second lever member that moves on a surface of said first body member during movement of said second body member relative to said first body member between said stable open position and said closed position.

5. A device according to claim 4 wherein when said second body member is at said closed position, said wheel member acts on a switch member to actuate said device.

6. A device according to claim 3 wherein when said second body member is at said closed position, said first lever member abuts said first body member.

7. A device according to claim 3 wherein said second body member is biased towards said stable open position.

8. A device according to claim 7 wherein said second body member is biased towards said stable open position by spring means disposed at the position where said first and second lever members are pivotally engaged with each other.

9. A device according to claim 3 wherein when said second body member is at said stable open position, the angle between said first lever member and said first body member differs from the angle between said second lever member and said first body member.

10. A device according to claim 9 wherein when said second body member is at said stable open position, the angle between said first lever member and said first body member is smaller than the angle between said second lever member and said first body member.

* * * * *